US006503011B2

(12) United States Patent
Kono

(10) Patent No.: US 6,503,011 B2
(45) **Date of Patent: *Jan. 7, 2003**

(54) RECORDING APPARATUS

(75) Inventor: Takeshi Kono, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 33 days.

(21) Appl. No.: 09/408,444

(22) Filed: Sep. 29, 1999

(65) Prior Publication Data

US 2002/0051668 A1 May 2, 2002

(30) Foreign Application Priority Data

Sep. 30, 1998 (JP) ..... 10-277882
Oct. 27, 1998 (JP) ..... 10-305229

(51) Int. Cl.[7] ..... B41J 13/16
(52) U.S. Cl. ..... 400/646; 400/625; 271/188; 271/209
(58) Field of Search ..... 400/625, 642, 400/646; 347/104; 271/188, 209

(56) References Cited

U.S. PATENT DOCUMENTS 4,469,319 A * 9/1984 Robb et al. ..... 271/3.1
5,280,901 A * 1/1994 Smith et al. ..... 271/188
5,393,151 A * 2/1995 Martin et al. ..... 400/642
5,685,538 A * 11/1997 Schlageter ..... 271/250
5,820,282 A 10/1998 Nakai ..... 400/642
5,874,979 A 2/1999 Ohyama ..... 347/104
6,181,908 B1 * 1/2001 Leemhuis et al. ..... 399/406

* cited by examiner

*Primary Examiner*—Ren Yan
(74) *Attorney, Agent, or Firm*—Fitzpatrick, Cella, Harper & Scinto

(57) ABSTRACT

A recording apparatus for performing the recording operation of a recording medium conveyed by a conveying portion using a recording portion has an irregularity forming discharging portion for forming the recording direction crossing a conveying direction of the recording medium in a position of the recording medium opposed to the recording portion, and discharging the recording medium to the exterior of the recording apparatus. The recording apparatus also has a supporting member for supporting the recording medium discharged by the irregularity forming discharging portion so as to curve the recording medium in a concave shape with respect to a direction perpendicular to the conveying direction. The supporting member is arranged in a position corresponding to a convex portion near each of both end portions of the recording medium formed in the shape having the corrugated irregularities with respect to the conveying direction.

15 Claims, 12 Drawing Sheets

RECORDING APPARATUS

BACKGROUND OF THE INVENTION

1. Field of the Invention

The present invention relates to a recording apparatus for performing the recording operation of a sheet member conveyed by a conveying means using a recording means.

2. Related Background Art

In an image forming apparatus using a conventional ink jet system, an image designated on a sheet of recording paper is generally reproduced as an ink image by cooperatively performing an operation for conveying the recording paper sheet in a subscanning direction, discharging control of a recording head for discharging ink to the recording paper sheet, and an operation for reciprocating the recording head in a main scanning direction (a direction perpendicular to the subscanning direction).

When the distance between a paper face and the recording head is excessively widened, the accuracy of an attaching position of an ink droplet discharged from the recording head is reduced so that the image is disturbed. Therefore, this distance is shortened as much as possible. However, in the ink jet recording system, the image is formed by discharging the ink having water as a main component to paper. Therefore, the paper is expanded and irregular "wrinkles" are caused. The paper face approaches the recording head by these "wrinkles" so that the paper face is rubbed by the recording head and the image is disturbed.

Therefore, a recording apparatus having an irregularity forming discharging portion as a means for controlling a generating degree of the "wrinkles" in the recording paper sheet is already proposed as a countermeasure for the rubbing of the recording paper sheet and the recording head caused by the generation of "wrinkles" in the recording paper sheet.

FIG. 10 is a cross-sectional view showing the irregularity forming discharging portion in the conventional recording apparatus.

As shown in FIG. 10, the irregularity forming discharging portion in the conventional recording apparatus is constructed by a conveying roller 101, a pinch roller 102, a platen 104 and a paper discharging roller 105. The conveying roller 101 conveys a recording paper sheet S to a portion below an ink discharging portion of the recording head 103. The pinch roller 102 is rotated by the conveying roller 101 and presses against the conveying roller 101 and presses the recording paper sheet S against the conveying roller 101. The platen 104 is opposed to the recording head 103 and supports the recording paper sheet S. The paper discharging roller 105 discharges the recording paper sheet S after printing.

Plural ribs 104*a* are arranged at an interval from 20 to 30 mm in the irregularity forming discharging portion of the platen 104. The recording paper sheet S is supported on an upper face of each of these ribs 104*a*. A height of each rib 104*a* is set such that the gas between the recording head 103 and the recording paper sheet S supported on the upper face of the rib 104*a* is minimized. A portion of the rib 104*a* opposed to the recording head 103 is arranged in parallel with the ink discharging portion of the recording head 103. An upstream side portion of the rib 104*a* in a conveying direction of the recording paper sheet in the vicinity of the conveying roller 101 is formed in a taper shape in which a height of this upstream side portion is gradually increased from a low position to the height of the upper face along the conveying direction of the recording paper sheet. In contrast to this, a portion of the platen 104 except for the rib 104*a* is formed such that the height of this portion is lower by about 2 mm than the upper face of the rib 104*a*.

An axis of the pinch roller 102 is arranged in a position shifted by about 1 to 2 mm on a downstream side in the conveying direction from an axis of the conveying roller 101. Thus, an end tip of the conveyed recording paper sheet S hits against the taper portion of the rib 104*a* and the recording paper sheet S is then pressed against the upper face of the rib 104*a*. The paper discharging roller 105 is formed in a shape in which a rubber portion 105*a* coming in contact with the recording paper sheet S is divided in an axial direction of the paper discharging roller 105. Each rubber portion 105*a* is arranged in a position conforming to each rib 104*a* of the platen 104 in the conveying direction of the recording paper sheet S.

In accordance with the recording apparatus constructed above, the recording paper sheet S is conveyed while the recording paper sheet S is pressed against the upper face of the rib 104*a*. At this time, a portion of the recording paper sheet S not supported by the rib 104*a* is pushed into a slightly low portion between ribs 104*a* adjacent to each other. In this state, when ink is discharged from the recording head 103 to the recording paper sheet S, the recording paper sheet S is expanded by water of the ink so that an expanded portion further enters a low portion between the ribs 104*a*. As a result, a portion of the recording paper sheet S supported on the upper face of each rib 104*a* becomes "convex", and a portion of the recording paper sheet S between ribs 104*a* adjacent to each other becomes "concave". Namely, irregularities having a corrugated plate shape in the main scanning direction are formed in the recording paper sheet S to which the ink is discharged. At this time, the gap between the recording paper sheet S and the recording head 103 is minimized in a portion (convex portion) supported on the upper face of the rib 104*a*. Accordingly, it is possible to prevent the paper face S and the recording head 103 from being rubbed. Thus, the recorded recording paper sheet S is conveyed and discharged outside the recording apparatus. The above irregularities are not formed in the subscanning direction in the recording paper sheet S recorded by discharging the ink.

As mentioned above, the height of each rib 104*a* is set such that the gas between the recording head 103 and the recording paper sheet S supported on the upper face of the rib 104*a* is minimized. Thus, dispersion in a gap difference of the irregularities of the recording paper sheet S can be set to lie within the range of an allowing gap amount at a time of the ink discharging operation of the recording head 103 so that a preferable image can be formed.

A fixing time of the ink to the paper face is required to form the image by discharging the ink to the paper face. However, when a printing speed of the recording apparatus is increased, the next recording paper sheet is discharged before the ink is fixed to the printed recording paper sheet discharged to the discharging portion. Accordingly, an end tip or a rear face of a subsequent recording paper sheet rubs an ink image of the recording paper sheet already discharged so that there is a fear of image disturbance.

Therefore, another recording apparatus is conventionally proposed. In this recording apparatus, a supporting member for supporting both ends of the subsequent recording paper sheet is arranged to prevent the subsequent recording paper sheet from being rubbed by the recording paper sheet already discharged to the discharging portion while the printed recording paper sheet is conveyed and the subsequent recording paper sheet is printed. Fixation of the ink to the recording paper sheet already discharged to the discharging portion is completed by natural drying while an image is printed on the subsequent recording paper sheet. Thus, the subsequent recording paper sheet can be discharged onto the recording paper sheet already discharged.

FIG. 11 is a cross-sectional view showing another conventional recording apparatus. FIG. 12 is a perspective view showing a supporting member in the conventional recording apparatus shown in FIG. 11.

As shown in FIG. 11, the conventional another recording apparatus is constructed such that a recording paper sheet fed by a paper feed means 111 is conveyed by a conveying portion 112 to a portion below a recording head 113 and is recorded, and is then stacked by a paper discharging roller 114 on a paper discharging tray 115. Further, in this conventional recording apparatus, a supporting member 116 for supporting the conveyed recording paper sheet S is arranged on a downstream side of the paper discharging roller 114 with respect to a conveying direction of the recording paper sheet S.

As shown in FIG. 12, the supporting member 116 supports the rear side of a printing face of the recording paper sheet S by a rib 116*a* in a position corresponding to an approximately entire width. At this time, the recording paper sheet S is flexed in a concave shape by the rib 116*a* supporting each of both side end portions of the recording paper sheet S so that "firmness" for preventing downward bending of an end tip portion of the recording paper sheet S is given to this recording paper sheet. Therefore, the recording paper sheet S is held in the air as shown in FIG. 12 until a rear end portion of the recording paper sheet S passes through the supporting member 116. Accordingly, while the recording paper sheet S is printed and is discharged and conveyed, the supporting member 116 holds the recording paper sheet S such that this recording paper sheet S is not rubbed by the recording paper sheet S already discharged to the paper discharging tray 115.

In this conventional recording apparatus, the ink of the recording paper sheet S already discharged onto the discharging tray 115 is naturally dried to secure an ink fixing time of the recording paper sheet S while a subsequent recording paper sheet S is printed.

When the subsequent recording paper sheet S is discharged onto the paper discharging tray 115, the supporting member 116 is rotated around an axis perpendicular to the conveying direction of the recording paper sheet S as a center and is escaped to a portion below the paper discharging roller 114 when a rear end of the recording paper sheet S reaches the paper discharging roller 114. An escaping operation of the supporting member 116 is associated with a conveying operation of the paper discharging roller 114. Accordingly, while the paper discharging roller 114 discharges the recording paper sheet S, the supporting member 116 is escaped as mentioned above.

Thus, in accordance with this conventional recording apparatus, the subsequent recording paper sheet S is stacked onto the recording paper sheet S already discharged onto the discharging tray 115 and naturally dried. Accordingly, no subsequent recording paper sheet S rubs an unfixed ink image so that disturbance of the recorded image is prevented.

However, when a recording apparatus is constructed by combining the irregularity forming discharging portion and the supporting member of the above-mentioned two recording apparatuss and the supporting member is simply arranged on a downstream side in the conveying direction from the irregularity forming discharging portion, the irregularities of a corrugated plate shape formed in the recording paper sheet by the irregularity forming discharging portion are broken by the supporting member. As a result, the gap between the recording head and the recording paper sheet is reduced in a portion to be "concave" rather than a portion to be "convex" in a position opposed to the recording head.

Here, this phenomenon will be explained with reference to FIG. 13.

FIG. 13 is a plan view showing a recording paper sheet conveying portion in the recording apparatus constructed by combining respective characterizing portions of the above conventional two recording apparatuss. In this recording apparatus, a supporting member 216 having a rib 216*a* is arranged on a downstream side in the conveying direction from a platen having a rib 204*a*. The constructions of a conveying roller 201, a pinch roller 202, the rib 204*a* arranged on the unillustrated platen, a paper discharging roller 205 and a rubber portion 205*a* in the recording apparatus shown in FIG. 13 are similar to those in the recording apparatus shown in FIG. 10. Constructions of the supporting member 216 and the rib 216*a* are similar to those in the recording apparatus shown in FIGS. 11 and 12. Accordingly, detailed explanations of these constructions are omitted here.

In the recording apparatus shown in FIG. 13, the rib 204*a* on the platen and the rubber portion 205*a* of the paper discharging roller 205 are arranged at an interval of 30 mm (15, 45, 75, 105, 135, 165 and 195 mm from a left-hand end) from a position of 15 mm from a left-hand end of the recording paper sheet S so as to convey the recording paper sheet of an A4 size. In this case, each of portions shown by one-dotted chain lines a to g in FIG. 13 is a portion to be "convex". Each of portions shown by two-dotted chain lines h to m in FIG. 13 is a portion to be "concave".

However, for example, when the rib 216*a* of the supporting member 216 is arranged in a position separated by 5 mm from each of both side ends of the recording paper sheet S, a portion of the recording paper sheet S supported by each rib 216*a* becomes "convex". Therefore, in addition to the "convex" of the above portions a to g, a convex portion is caused on each of lines n and o connecting each rib 216*a* and each rubber portion 205*a* at both ends of the paper discharging roller 205. Thus, portions p and q to be originally "concave" become "convex" and the recording paper sheet S is expanded by attaching the ink to this recording paper sheet. Accordingly, the portions p and q highly float and rise from portions of lines a to g to be originally "convex". Thus, a problem exists in that a printing face of the recording paper sheet comes in contact with the recording head.

SUMMARY OF THE INVENTION

An object of the present invention is to provide a recording apparatus which can prevent a sheet member from being rubbed by a recording means, and can prevent a recorded unfixed ink image from being rubbed and disturbed by a subsequent sheet member.

Another object of the present invention is to provide a recording apparatus for performing the recording operation of a recording medium conveyed by conveying means using recording means, said apparatus comprising: irregularity forming discharging means for forming said recording medium in a shape having corrugated irregularities in a direction crossing a conveying direction of the recording medium in a position of said recording medium opposed to said recording means, and discharging said recording medium to the exterior of said recording apparatus; and supporting means for supporting said recording medium discharged by said irregularity forming discharging means so as to curve the recording medium in a concave shape with respect to a direction perpendicular to said conveying direction, wherein the supporting means is arranged in a position corresponding to a convex portion near each of both end portions of the recording medium formed in the shape having said corrugated irregularities with respect to said conveying direction.

Another object of the present invention is to provide an image forming apparatus for discharging a sheet forming an image thereon to a discharging portion, said apparatus comprising: recording means having a carriage for moving a recording head in a width direction and a roller for conveying the sheet, and forming the image to the conveyed sheet; discharging means having a set of a first discharging roller constructed by a roller and a rotating body rotated by the roller on a downstream side in a sheet discharging direction from the recording means, and a set of a second discharging roller on a further downstream side; supporting means of a projecting shape arranged in the vicinity of both end portions of the discharged sheet in its width direction between the first and second discharging rollers of said discharging means in a conveying direction of the discharged sheet, or approximately in the same column as the second discharging roller set; and pushing-up means for biasing said supporting means from a second position to a first position by a resilient member such as a spring, and the like, wherein the supporting means is able to be moved to the first position for projecting the supporting means to a conveying path of said sheet and raising a face of said sheet on a side opposed to a recorded face of said sheet; and supporting the sheet by curving the sheet in a concave shape in the width direction of the sheet, and able to be also moved to the second position escaped from the conveying path of the sheet.

DETAILED DESCRIPTION OF THE PREFERRED EMBODIMENTS

The embodiments of the present invention will next be described with reference to the drawings.

Figure 1:
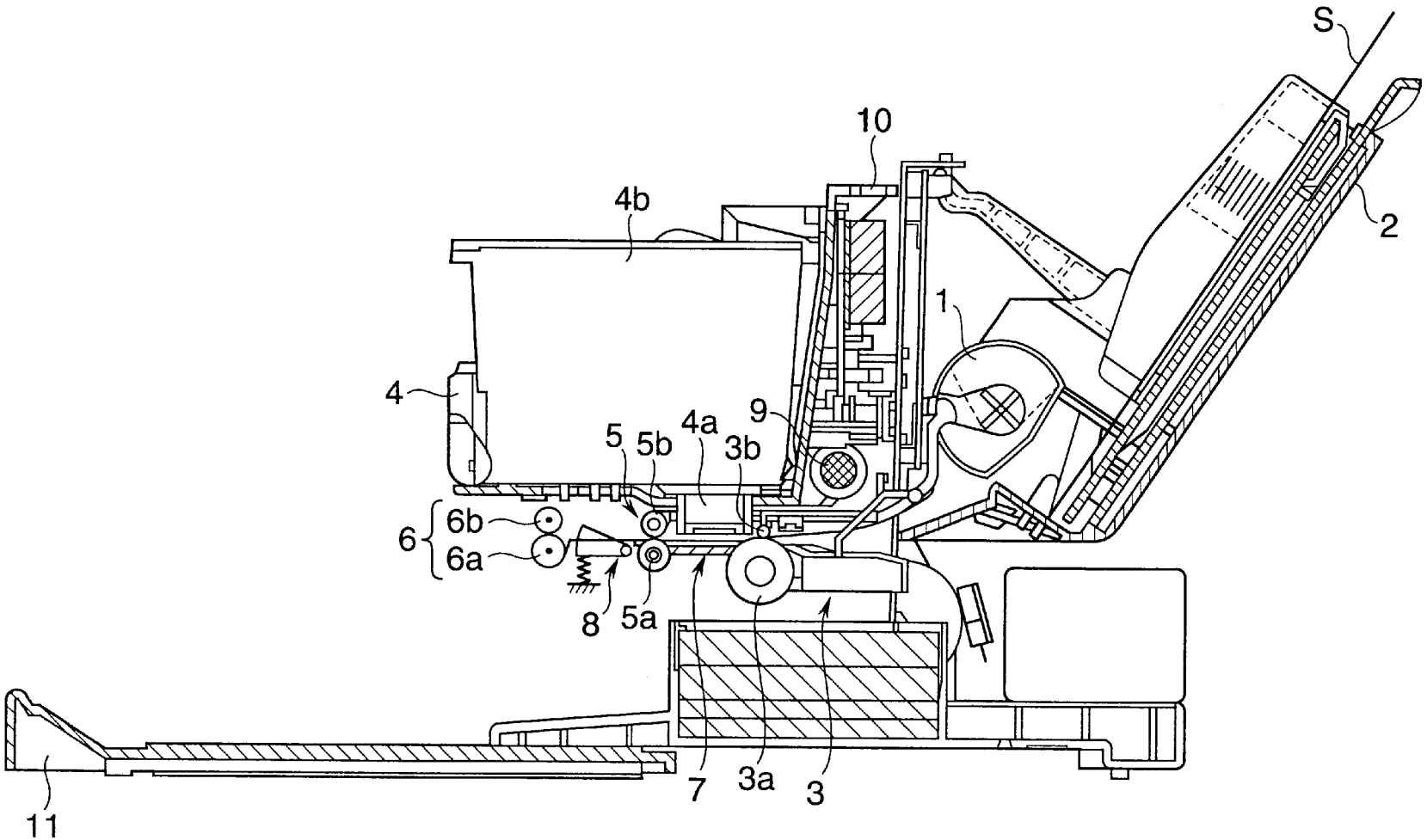
FIG. 1 is a cross-sectional view showing a first embodiment of a recording apparatus of the present invention.

FIG. 1 is a cross-sectional view showing a first embodiment of a recording apparatus of the present invention. As shown in FIG. 1, the recording apparatus in this embodiment has a feed portion, a conveying portion 3, a recording head 4*a*, a first discharging portion 5 and a second discharging portion. The feed portion has a feed roller 1 for feeding a recording paper sheet S as a recording medium arranged on a paper feed tray 2 into the recording apparatus. The conveying portion 3 constitutes a conveying means for conveying the recording paper sheet S fed into the recording apparatus. The recording head 4*a* constitutes a recording means for recording an image to the recording paper sheet S conveyed by the conveying portion 3. The first discharging portion 5 and the second discharging portion discharge the recording paper sheet S recording an image thereon onto a paper discharging tray 11.

The construction of each portion of the above recording apparatus will next be explained.

The feed roller 1 of the feed portion separates recording paper sheets S on the paper feed tray 2 one by one from an uppermost sheet in cooperation with an unillustrated separating claw, and feeds this recording paper sheet S into the recording apparatus.

The conveying portion 3 is constructed by a conveying roller 3*a* rotated by an unillustrated driving means and a driven roller 3*b*. The driven roller 3*b* is rotated by the conveying roller 3*a* and presses against the conveying roller 3*a* and presses the recording paper sheet S against the conveying roller 3*a*. The recording paper sheet S is conveyed by this conveying portion 3 to a position opposed to the recording head 4*a*.

The recording head 4*a* is a so-called ink jet recording head for discharging an ink droplet to the recording paper sheet S conveyed by the conveying portion 3 and recording an image to this recording paper sheet S. A carriage 4 can be reciprocated along a guide shaft 9 and a guide rail 10 extending in a width direction of the recording paper sheet S. The recording head 4*a* and an ink tank 4*b* for storing the ink supplied to the recording head 4*a* are mounted to the carriage 4. The recording head 4*a* and the ink tank 4*b* are integrated with each other and can be detachably attached to the carriage 4. The recording head 4*a* is operated in accordance with a reciprocating movement of the carriage 4 and discharges the ink droplet according to an image signal to the recording paper sheet S supported by the platen 7 on its rear face and records the ink image to this recording paper sheet S. The recording head 4*a* and the ink tank 4*b* may be set to a mode in which the recording head 4*a* and the ink tank 4*b* can be separated and coupled to each other.

The recording head 4*a* has a fine liquid discharging port (orifice), a liquid flow path communicated with the liquid discharging port, an energy acting portion arranged in this liquid flow path, and an energy generating means for generating droplet forming energy applied to a liquid in the energy acting portion.

Such energy generating means for generating the droplet forming energy is constructed by a means using an electricity machine converting body such as a piezo element, etc., a means for heating a liquid by irradiating an electromagnetic wave such as a laser, etc. and discharging the droplet by an action using this heating, or a means for heating the liquid by thermal energy generated in an electricity heat converting body such as a heating element, etc. having a heating resistor and discharging the liquid, etc. In these means, the recording head constructed by discharging the liquid by thermal energy can record an image with high resolution since the liquid discharging port (orifice) for discharging the ink droplet and forming the droplet for discharge can be arranged with high density. In particular, the recording head using the electricity heat converting body as an energy generating means is easily made compact and is easily mounted with high density and manufacturing cost of this recording head is low so that this recording head is advantageous.

The recording head 4*a* in this embodiment has an electricity heat converting body for generating thermal energy when an electric current flow through this electricity heat converting body. This recording head 4*a* is constructed such that the thermal energy is generated by flowing an electric current through the electricity heat converting body in accordance with a recording signal, and an bubble is caused in the ink by film-boiling the ink and a recording operation is performed by discharging the ink from the discharging port by utilizing growth and contraction of this bubble. Further, such energy generating means may be constructed by using an electricity machine converting body such as a piezo element, etc.

The first discharging portion 5 is constructed by a first discharging roller 5*a* rotated by an unillustrated driving means, and a spur 5*b*. The spur 5*b* is rotated by the first discharging roller 5*a* and presses against the first discharging roller 5*a* and presses the recording paper sheet S against the first discharging roller 5*a*. The second discharging portion 6 is constructed by a second discharging roller 6*a* rotated by an unillustrated driving means, and a spur 6*b*. The spur 6*b* is rotated by the second discharging roller 6*a* and presses against the second discharging roller 6*a* and presses the recording paper sheet S against the second discharging roller 6*a*. The discharging portions 5, 6 discharge the recording paper sheet S recording an image thereto by the recording head 4*a* to the discharging tray 7 in a state in which a recording face of the recording paper sheet S is set to an upper face. Here, each of the spurs 5*b*, 6*b* is a rotating body constructed such that a contact area with respect to the recording paper sheet S is small and no ink image is disturbed even when the rotating body comes in contact with a side of the recording paper sheet recording the ink image thereon by discharging the ink.

As explained by using the prior art, when the recording sheet S is paper, the recording paper sheet S is expanded and "wrinkles" are caused when the ink having water as a main component is discharged to the recording paper sheet S and the ink image is formed. Therefore, the recording paper sheet S floats and rises and is rubbed by the recording head. Further, when the recording paper sheet S discharged to the exterior of the recording apparatus by the discharging portions 5, 6 is simply conveyed by the rollers 5*a*, 6*a*, an end tip of the recording paper sheet S is bent downward by its empty weight. When the recording paper sheet S is continuously discharged in this bending state, the downward bent end tip of the recording paper sheet S rubs an ink image face of the recording paper sheet S already discharged onto the discharging tray 7.

Therefore, the recording apparatus in this embodiment has an irregularity forming discharging portion and a recording paper sheet supporting portion. In the irregularity forming discharging portion, irregularities of a corrugated plate shape are formed in the recording paper sheet S to prevent the recording paper sheet S from being rubbed by the recording head. The irregularity forming discharging portion discharges the recording medium to the exterior of the above recording apparatus. The recording paper sheet supporting portion supports the recording paper sheet S in a state curved in a concave shape in a width direction to prevent the recording paper sheet S from being bent downward.

Figure 2:
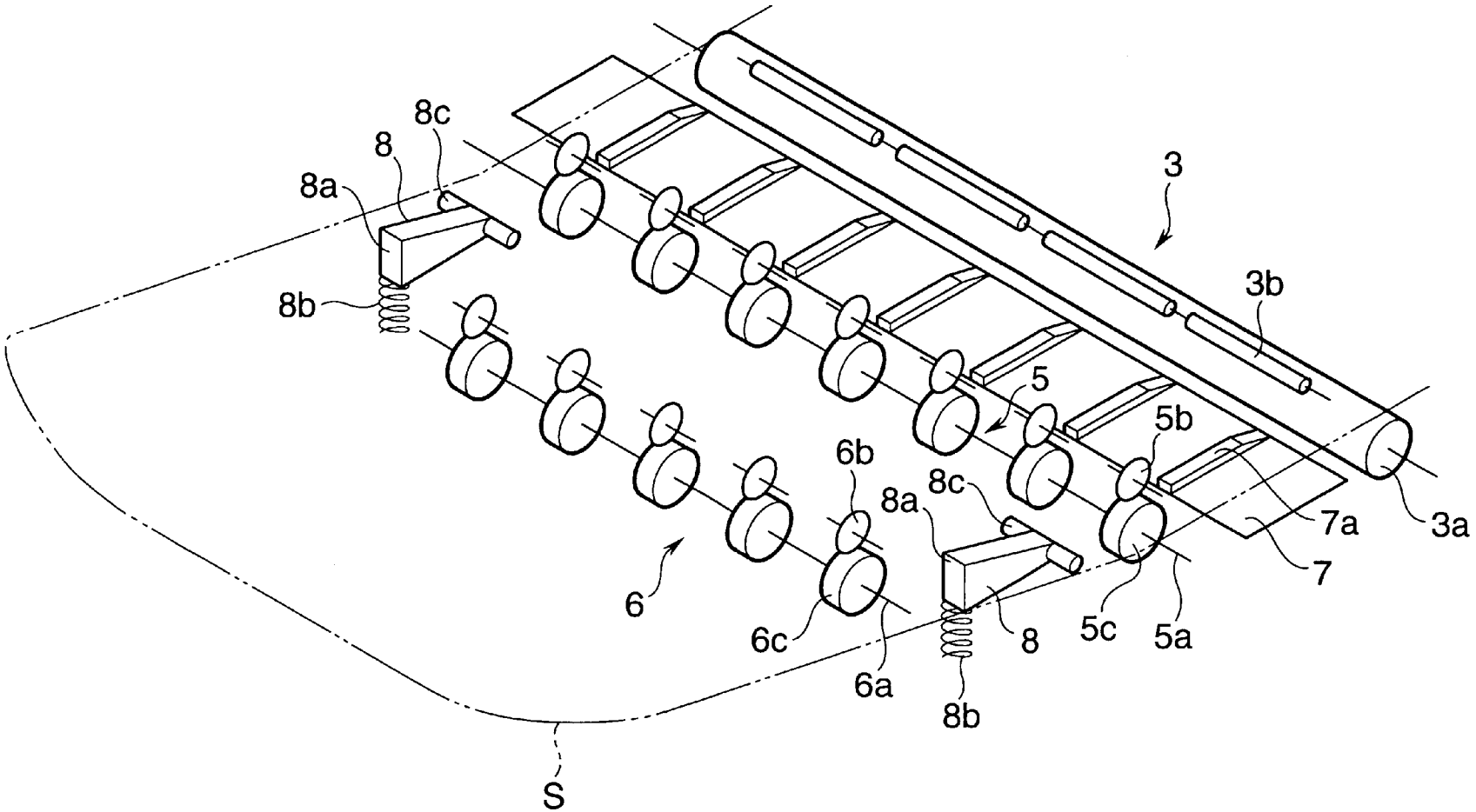
FIG. 2 is a perspective view showing an irregularity forming discharging portion and a recording paper sheet supporting portion of the recording apparatus shown in FIG. 1.

Here, the irregularity forming discharging portion in the recording apparatus of this embodiment will next be explained mainly with reference to FIG. 2. FIG. 2 is a perspective view showing the irregularity forming discharging portion and the recording paper sheet supporting portion of the recording apparatus shown in FIG. 1.

As shown in FIG. 2, the irregularity forming discharging portion in the recording apparatus of this embodiment is constructed by the above conveying portion 3, the platen 7 and the above first paper discharging portion 5. The conveying portion 3 has the conveying roller 3*a* and the driven roller 3*b*. The platen 7 is opposed to the recording head 4*a* and supports the recording paper sheet S. The first paper discharging portion 5 discharges the recording paper sheet S after an image is recorded to this recording paper sheet S.

Plural ribs 7*a* are arranged at an interval from 20 to 30 mm in the irregularity forming discharging portion of the platen 7. The recording paper sheet S is supported on an upper face of each of these ribs 7*a*. A height of each rib 7*a* is set such that the gap between the recording head 4*a* and the recording paper sheet S supported on the upper face of the rib 7*a* is minimized. A portion of the rib 7*a* opposed to the recording head 4*a* is arranged in parallel with an ink discharging portion of the recording head 4*a*. A portion of the rib 7*a* on an upstream side in a conveying direction of the recording paper sheet in the vicinity of the conveying roller 3*a* is formed in a taper shape in which this portion of the rib 7*a* is gradually raised along the conveying direction of the recording paper sheet S from a position lower by about 1 mm than the upper face of the rib 7*a* to a height of this upper face. In contrast to this, a portion of the platen 7 except for the rib 7*a* is formed such that this portion is lower by about 2 mm than the upper face of the rib 7*a*.

An axis of the driven roller 3*b* is arranged in a position shifted by about 1 to 2 mm on a downstream side in the conveying direction from an axis of the conveying roller 3*a*. An end tip of the conveyed recording paper sheet S hits against the taper portion of the rib 7*a* and the recording paper sheet S is then pressed against the upper face of the rib 7*a*.

The first discharging roller 5*a* is constructed such that plural rubber rollers 5*c* coming in contact with the recording paper sheet S are respectively formed to have about 4 mm in width and are attached to a metallic shaft at an equal interval. Each rubber roller 5*c* is arranged in a position conforming to each rib 7*a* of the platen 7 with respect to the conveying direction of the recording paper sheet S. In this embodiment, the rib 7*a* on the platen 7 and the rubber roller 5*c* of the first discharging roller 5 are arranged at an interval of 30 mm (15, 45, 75, 105, 135, 165, 195 mm from a left-hand end) from a position separated by 15 mm from a left-hand end of the recording paper sheet S of an A4 size.

The recording paper sheet S is conveyed by the above construction while the recording paper sheet S is pressed against the upper face of the rib 7*a*. At this time, when ink is discharged from the recording head 4*a* to the recording paper sheet S, the recording paper sheet S is expanded by water of the ink and an expanded portion enters a low portion between ribs 7*a*. As a result, a portion of the recording paper sheet S supported on the upper face of the rib 7*a* becomes "convex" and a portion of the recording paper sheet S between the ribs 7*a* adjacent to each other becomes "concave". Namely, irregularities of a corrugated plate shape in a main scanning direction (a reciprocating direction of the recording head 4*a*) are formed in the recording paper sheet S having the discharged ink. At this time, the gap between the recording paper sheet S and the recording head 4*a* is minimized in a portion (convex portion) supported by the upper face of the rib 7*a* so that no recording paper sheet S floats and rises highly from the convex portion. Therefore, it is possible to prevent the recording paper sheet S from being rubbed by the recording head 4*a*. The recording paper sheet S recorded above is conveyed and discharged to the exterior of the recording apparatus. In the recording paper sheet S recorded by discharging the ink, no irregularities mentioned above are formed in a subscanning direction (conveying direction of the recording paper sheet S).

Further, as mentioned above, a height of each rib 7*a* is set so as to minimize the gap between the recording head 4*a* and the recording paper sheet S supported on the upper face of the rib 7*a*. Thus, dispersion in a gap difference of the irregularities of the recording paper sheet S can be set to lie within the range of an allowing gap amount at an ink discharging time of the recording head 4*a* so that a preferable image can be formed.

The recording paper sheet supporting portion in the recording apparatus of this embodiment will next be explained mainly with reference to FIG. 2.

As shown in FIG. 2, the recording paper sheet supporting portion in the recording apparatus of this embodiment has two supporting members 8 arranged between the respective discharging portions 5 and 6 mentioned above. The supporting members 8 are arranged in positions separated by 15 mm and 195 mm from a left-hand end of the recording paper sheet S. The supporting members 8 are also located in positions which correspond to respective ribs 7*a* at both ends of the platen 7 and respective rubber rollers 5*c* at both ends of the first discharging roller 5*a* with respect to the conveying direction of the recording paper sheet S, and substantially conform to these ribs 7*a* and these rubber rollers 5*c* in a range capable of obtaining effects of the present invention. (This construction is also similarly used in each of embodiments described later.) Further, the two supporting members 8 are arranged in positions in which the two supporting members 8 correspond to each other and conform to each other with respect to a direction crossing the conveying direction of the recording paper sheet S, most preferably, with respect to a direction perpendicular to this conveying direction. (This construction is also similarly used in each of embodiments described later.)

Each supporting member 8 is formed in a projecting shape in which the supporting member 8 is gradually raised from an upstream side to a downstream side in the conveying direction. A lowermost downstream side of the supporting member 8 is set to a vertex portion 8*a*. The vertex portion 8*a* is located slightly on the downstream side in the conveying direction from an intermediate position between the discharging portions 5 and 6. The supporting member 8 is supported so as to be swung around a swinging central axis 8*c* as a center, and is further biased upward in FIG. 2 by a spring 8*b*. The vertex portion 8*a* of the supporting member 8 can be moved between a first position (see FIG. 3) projecting to a position higher than a discharging path of the recording paper sheet in each of the discharging portions 5, 6 and a second position (see FIG. 4) as a position lower than the above discharging path.

Similar to the first discharging roller 5*a*, the second discharging roller 6*a* is also formed to have about 4 mm in width and is constructed such that plural rubber rollers 6*c* coming in contact with the recording paper sheet S are attached to a metallic shaft at an equal interval. These rubber rollers 6*c* are arranged in five positions separated by 45, 75, 105, 135 and 165 mm from a left-hand end portion of the recording paper sheet S of an A4 size. The rubber rollers 6*c* are constructed such that the rubber rollers 6*c* are arranged at the same interval as the ribs 7*a* of the platen 7 within a range narrower than the distance between both the supporting members 8. A rear end of the recording paper sheet S is reliably discharged by arranging the second discharging portion 6 on the downstream side in the conveying direction from the supporting members 8 so that the recording paper sheet S can be reliably discharged.

The recording apparatus of this embodiment is constructed such that ink of the recording paper sheet S already discharged onto the discharging tray 11 is naturally dried to secure an ink fixing time of the recording paper sheet S while a subsequent recording paper sheet S is printed.

Figure 5:
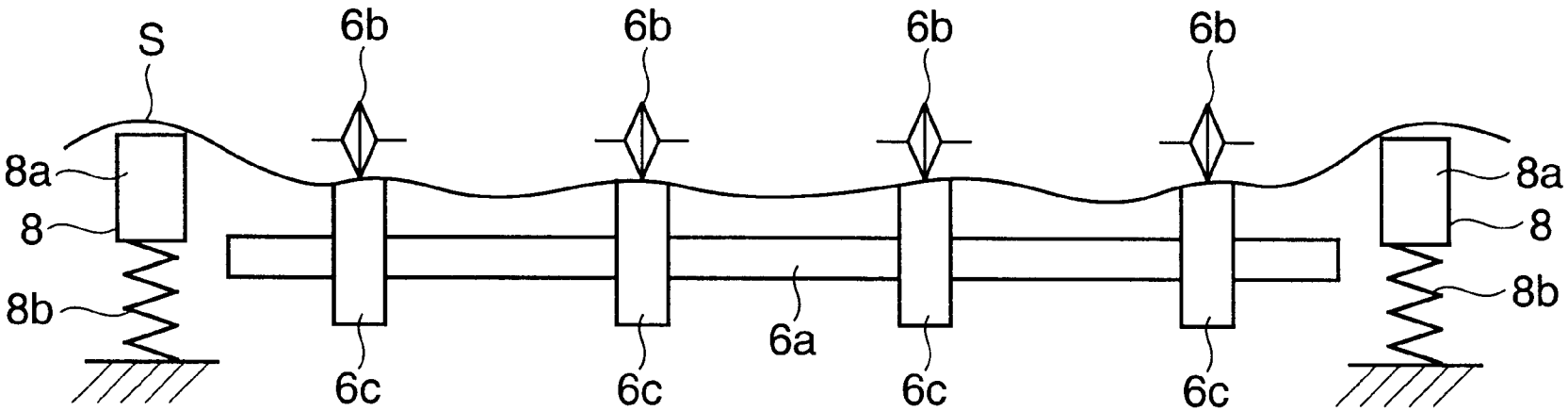
FIG. 5 is a front view showing a second discharging portion and the supporting member shown in FIG. 1, etc. in a discharging state of a recording sheet of plain paper.

FIG. 5 is a front view showing the second discharging portion and the supporting member shown in FIG. 1, etc. in a discharging state of the recording sheet of plain paper.

As shown in FIG. 5, each of portions of the recording paper sheet S near its both side ends on a face on a side opposed to a recording face of the recording paper sheet S is raised by the supporting member 8 by locating the supporting member 8 in the first position. Accordingly, the recording paper sheet S is curved in a concave shape in a width direction and "firmness" is caused in the recording paper sheet S so that the recording paper sheet S is cantilevered. Thus, no end tip of the recording paper sheet S is bent downward during a discharging operation, and the subsequent recording paper sheet S can be discharged and stacked without rubbing an ink image face of the recording paper sheet S already discharged onto the discharging tray 11.

Figure 6:
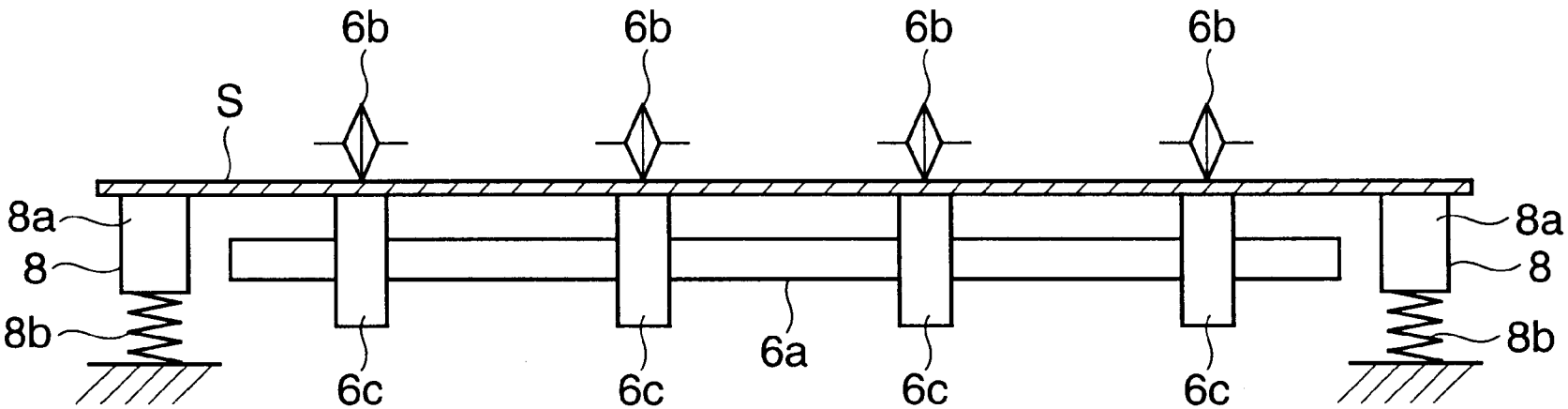
FIG. 6 is a front view showing the second discharging portion and the supporting portion shown in FIG. 1, etc. in a discharging state of a recording paper sheet of high rigidity.

FIG. 6 is a front view showing the second discharging portion and the supporting member shown in FIG. 1, etc. in a discharging state of the recording paper sheet of high rigidity.

When the recording paper sheet S of strong rigidity such as thick paper, a postcard, etc. is used and the supporting member 8 is located in the above first position and the recording paper sheet S begins to be deformed in a concave shape by the supporting member 8, the rigidity of the recording paper sheet is stronger than force of this deformation. Thus, the supporting member 8 prevents conveyance of the recording paper sheet and problems of impossibility of the conveyance and the disturbance of a conveying accuracy are caused. Therefore, when the recording paper sheet S of strong rigidity such as thick paper, etc. is used, the above problems are avoided by arranging the supporting member 8 in the second position below a conveying path of the recording paper sheet as shown in FIG. 6.

In the case of the recording paper sheet S of strong rigidity such as thick paper, etc., the rigidity of the recording paper sheet S itself is high. Therefore, the recording paper sheet S is supported by discharging roller pairs in two columns of the first discharging portion 5 and the second discharging portion 6 so that the recording paper sheet S can be cantilevered without bending an end tip of the recording paper sheet S downward even when no supporting member 8 is used. Thus, similar to the above case, the recording paper sheet S can be discharged and stacked without rubbing an ink image face of the recording paper sheet S already discharged onto the discharging tray 11.

In the case of the recording paper sheet S weak in "firmness" and relatively light in weight such as plain paper, etc., a load for pressing the supporting member 8 by the recording paper sheet S is small by biasing the supporting member 8 by the spring 8*b*. Therefore, the supporting member 8 is held in the first position (see FIG. 5) and the recording paper sheet S is curved and supported in a concave shape in a width direction. In contrast to this, in the case of the recording paper sheet S strong in "firmness" and relatively heavy in weight such as thick paper, etc., the supporting member 8 is pressed by the weight and rigidity of the recording paper sheet S so that the supporting member 8 is escaped until the second position (see FIG. 6). Thus, the supporting member 8 can automatically cope with a quality of the recording paper sheet S.

As explained above, the recording apparatus in this embodiment has the discharging portions 5, 6 for discharging the recording paper sheet S having the irregularities of a zinc corrugated plate shape formed in the width direction by the rib 7*a* of the platen 7 while this irregular shape is held. This recording apparatus also has the supporting member 8 for raising a convex portion near each of both side end portions of the recording paper sheet S and for curving the recording paper sheet S in a concave shape in the width direction. Accordingly, no portion to be originally "concave" in the irregularities formed in the zinc corrugated plate shape become "convex" by a raising operation of the supporting member 8. Accordingly, it is possible to prevent a printing face of the recording paper sheet S from coming in contact with the recording head.

(Second Embodiment)

Figure 7:
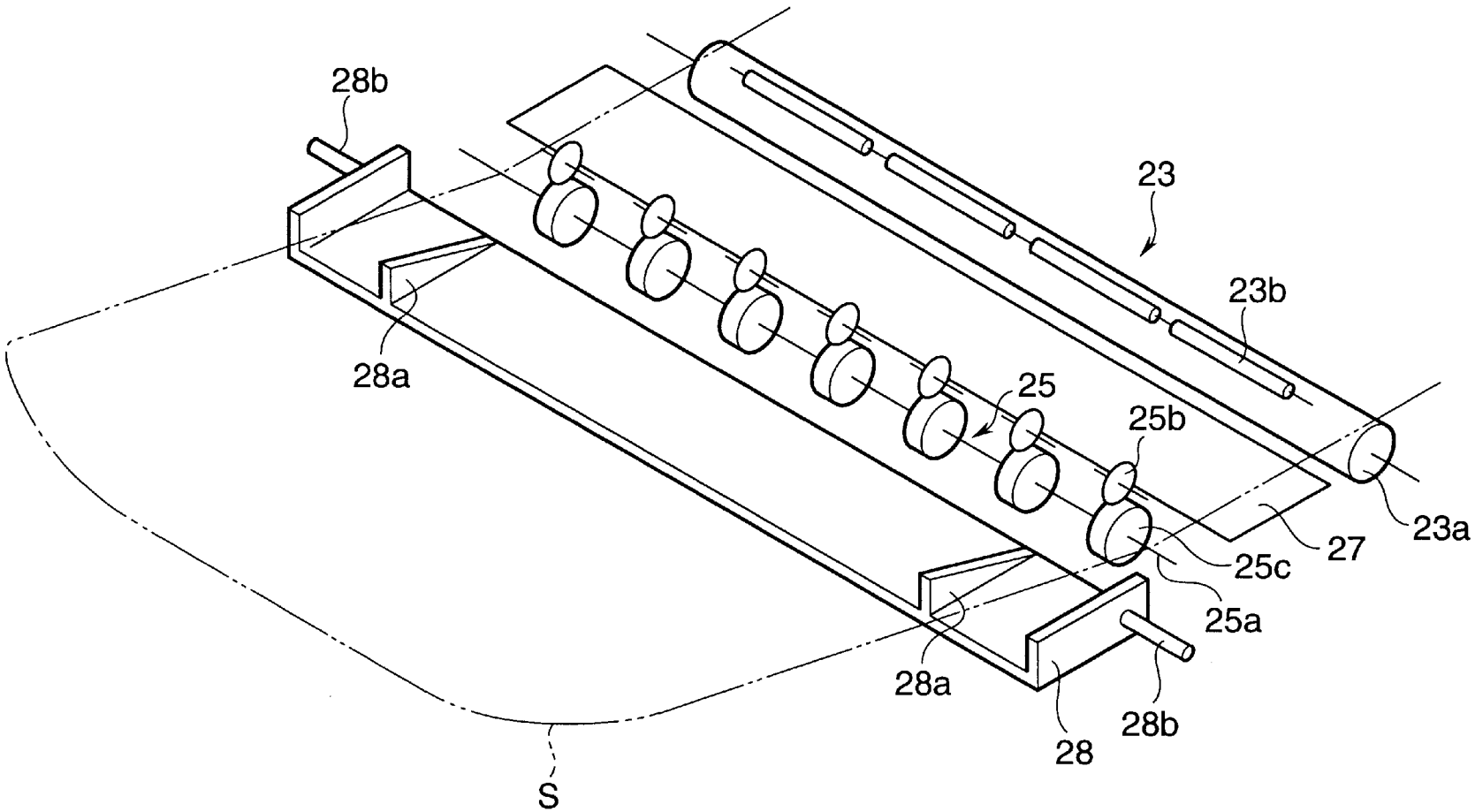
FIG. 7 is a perspective view showing an irregularity forming discharging portion and a recording paper sheet supporting portion in a second embodiment of the recording apparatus of the present invention.

FIG. 7 is a perspective view showing an irregularity forming discharging portion and a recording paper sheet supporting portion in a second embodiment of the recording apparatus of the present invention. Here, each of constructions of an unillustrated paper feed roller, a paper feed tray, a carriage, a recording head, an ink tank, a guide shaft, a guide rail, a conveying portion 23, etc. in the recording apparatus of this embodiment is similar to that in the recording apparatus shown in FIG. 1, etc. Accordingly, a detailed explanation of these constructions is omitted here.

As shown in FIG. 7, in this embodiment, a platen 27 formed in the shape of a flat plate on its upper face is arranged on a downstream side from the conveying portion 23 with respect to a conveying direction of the recording paper sheet S. The platen 27 has a function for guiding an end tip of the recording paper sheet S conveyed from the conveying portion 23 to a discharging portion 25. The discharging portion 25 discharges the recording paper sheet S to the exterior of the recording-apparatus and forms irregularities of a zinc corrugated plate shape in the recording paper sheet S to prevent the recording paper sheet S from being rubbed by the recording head. This discharging portion 25 is arranged on a further downstream side of the platen 27. Further, a supporting member 28 is arranged on the downstream side of the discharging portion 25 and flexes the recording paper sheet S discharged by the discharging portion 25 in a concave shape to prevent the recording paper sheet S from being bent downward.

The discharging portion 25 in this embodiment corresponds to the first discharging portion in the first embodiment. In this embodiment, no construction corresponding to the second discharging portion in the first embodiment is arranged.

Here, the irregularity forming discharging portion in the recording apparatus of this embodiment will be explained.

The irregularity forming discharging portion in the recording apparatus of this embodiment is constructed by a conveying portion 23 having a conveying roller 23*a* and a driven roller 23*b*, a platen 27 opposed to a recording head and supporting the recording paper sheet S, and a discharging portion 25 for discharging the recording paper sheet S after an image is recorded to the recording paper sheet S. The discharging roller 25*a* of the discharging portion 25 in this embodiment is constructed such that plural rubber rollers 25*c* coming in contact with the recording paper sheet S are formed to have about 4 mm in width and are attached to a metallic shaft at an equal interval. The rubber rollers 25*c* are arranged at an interval of 30 mm (15, 45, 75, 105, 135, 165, 195 mm from a left-hand end) from a position separated by 15 mm from a left-hand end of the recording paper sheet S of an A4 size. The height of a vertex of each rubber roller 25*c* is set to be higher by about 2 mm than an upper face of the platen 27. A spur 25*b* comes in contact with each rubber roller 25*c*.

In the conveying portion 23 of this embodiment, an axis of the driven roller 23*b* is also located on a downstream side by about 2 mm with respect to an axis of the conveying roller 23*a*. Accordingly, the recording paper sheet S conveyed from the conveying portion 23 is pressed against the upper face of the platen 27 and the discharging roller 25*a*.

In the recording apparatus constructed above, the recording paper sheet S conveyed by the conveying portion 23 is pressed against the rubber roller 25*c*. When ink is discharged from the recording head to the recording paper sheet S, the recording paper sheet S is expanded by water of the ink and an expanded portion enters a low portion between the respective rubber rollers 25*c*. As a result, a portion of the recording paper sheet S supported by the rubber rollers 25*c* becomes "convex", and a portion of the recording paper sheet S between the rubber rollers 25*c* adjacent to each other becomes "concave". Namely, in the recording paper sheet S having the discharged ink, the irregularities of a zinc corrugated plate shape are formed in a main scanning direction (a reciprocating direction of the recording head). At this time, the gap between the recording paper sheet S and the recording head is minimized in a portion (convex portion) supported by the rubber rollers 25*c*. Accordingly, it is possible to prevent the paper face S from being rubbed by the recording head. Thus, the recorded recording paper sheet S is conveyed and discharged outside the recording apparatus. In the recording paper sheet S recorded by discharging the ink, no irregularities mentioned above are formed in a subscanning direction.

The recording paper sheet supporting portion in the recording apparatus of this embodiment will next be explained.

The recording paper sheet supporting portion in supporting member 28 arranged on a downstream side in a conveying direction from the discharging portion 25.

The supporting member 28 supports the rear face of a printing face of the recording paper sheet S over an entire width. Two ribs 28*a* are arranged on an upper face of the supporting member 28. Each rib 28*a* is arranged in each of positions separated by 15 mm and 195 mm from a left-hand end of the recording paper sheet S. Each rib 28*a* is located in a position conforming to each of the rubber rollers 25*c* at both ends of the discharging roller 25*a* with respect to a conveying direction of the recording paper sheet S. Further, the height of a vertex portion of each rib 28*a* is set to be higher than the rubber rollers 25*c*. The supporting member 28 is supported so as to be rotated around a rotating central shaft 28*b* as a center perpendicular to the conveying direction of the recording paper sheet S.

In accordance with the above construction, the recording paper sheet S discharged from the discharging portion 25 is curved in a concave shape in the width direction and is cantilevered. Thus, no end tip of the recording paper sheet S is bent downward and the recording paper sheet S can be discharged and stacked without rubbing an ink image face of the recording paper sheet S already discharged onto the discharging tray.

Further, in this embodiment, when a rear end of the discharged recording paper sheet S passes through the discharging roller 25*a*, the supporting member 8 is rotated around the rotating central axis 28*b* as a center and is escaped to a position below the discharging roller 25*a*. Thus, a subsequent recording paper sheet S recording an image thereto is stacked to the recording paper sheet S already discharged onto the discharging tray from just above. Accordingly, no ink image face of the recording paper sheet S already discharged is rubbed by the subsequent recording paper sheet S so that disturbance of the image face can be prevented. An escaping operation of the supporting member 28 is associated with a discharging operation of the discharging roller 25*a* and the supporting member 28 is escaped as mentioned above while the discharging roller 25*a* discharges the recording paper sheet S.

As explained above, each rib 28*a* is arranged in a position conforming to each of the rubber rollers 25*c* at both ends of the discharging roller 25*a* with respect to the conveying direction of the recording paper sheet S. Thus, the rear face of a convex portion at each of both side ends among the irregularities of a zinc corrugated plate shape formed in the recording paper sheet S by the discharging portion 25 is supported by the rib 28*a* of the supporting member 28. A rear face of each concave portion of the recording paper sheet S is escaped to a portion between both ribs 28*a* of the supporting member 28. Accordingly, in this embodiment, no portion to be originally "concave" in the irregularities of the recording paper sheet S becomes "convex" by a raising operation of the supporting member 28. Therefore, it is possible to prevent a printing face of the recording paper sheet S from coming in contact with the recording head.

(Third Embodiment)

Figure 8:
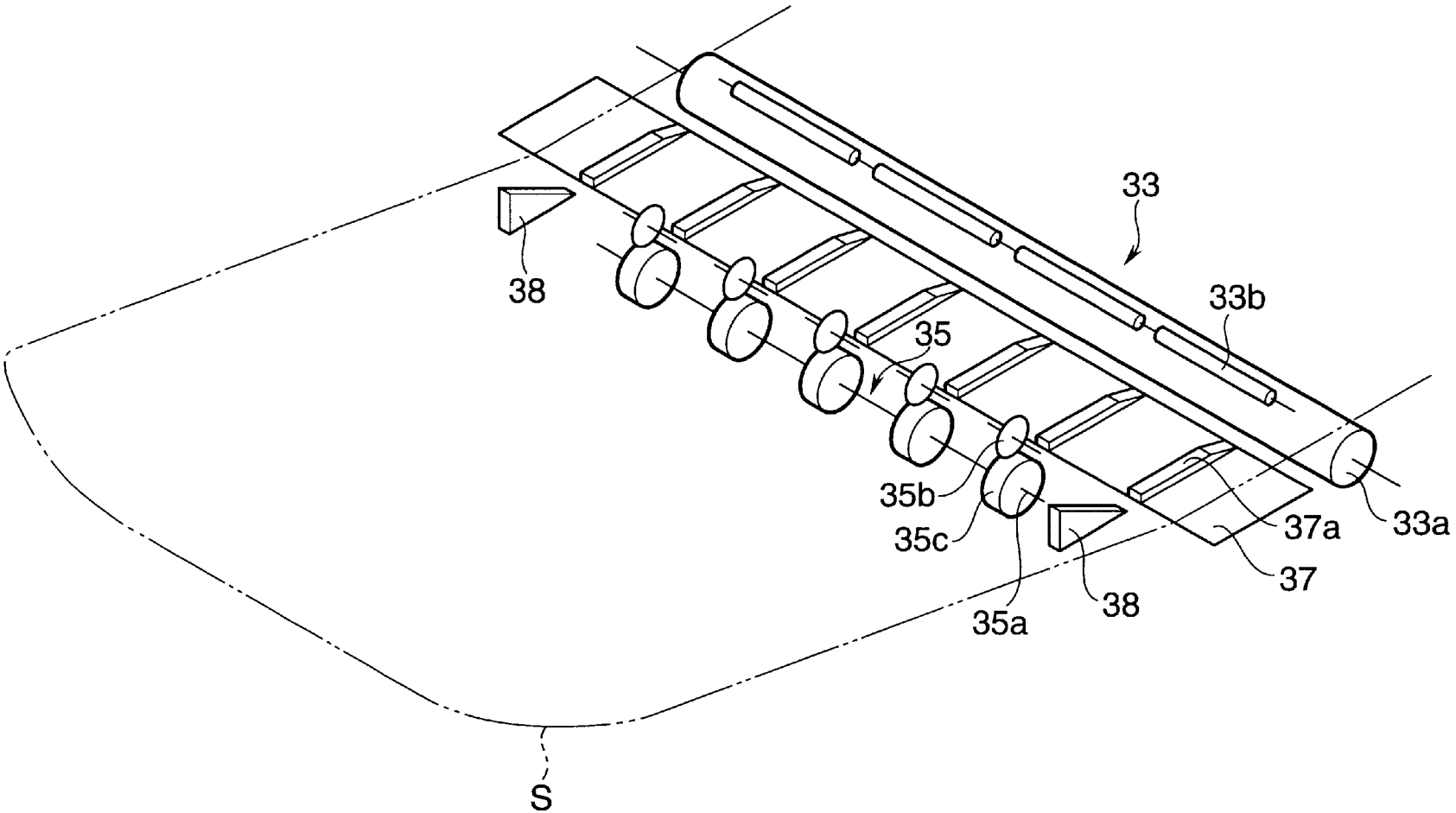
FIG. 8 is a perspective view showing an irregularity forming discharging portion and a recording paper sheet supporting portion in a third embodiment of the recording apparatus of the present invention.

FIG. 8 is a perspective view showing an irregularity forming discharging portion and a recording paper sheet supporting portion in a third embodiment of the recording apparatus of the present invention. Here, each of constructions of an unillustrated paper feed roller, a paper feed tray, a carriage, a recording head, an ink tank, a guide shaft, a guide rail, a conveying portion 23, etc. in the recording apparatus of this embodiment is similar to that in the recording apparatus shown in FIG. 1, etc. Accordingly, a detailed explanation of these constructions is omitted here.

As shown in FIG. 8, in this embodiment, a platen 37 having plural ribs 37*a* on its upper face is arranged on a downstream side from a conveying portion 33 with respect to the conveying direction of a recording paper sheet S. A discharging portion 35 for discharging the recording paper sheet S to the exterior of the recording apparatus is arranged on a further downstream side of the platen 37. Further, a supporting member 38 is arranged near both end portions of a discharging roller 35*a* of the discharging portion 35 and flexes the recording paper sheet S discharged by the discharging portion 35 in a concave shape to prevent the recording paper sheet S from being bent downward.

The discharging portion 25 in this embodiment corresponds to the first discharging portion in the first embodiment. In this embodiment, no construction corresponding to the second discharging portion in the first embodiment is arranged.

Here, the irregularity forming discharging portion in the recording apparatus of this embodiment will be explained.

The irregularity forming discharging portion in the recording apparatus of this embodiment is constructed by a conveying portion 33 having a conveying roller 33*a* and a driven roller 33*b*, a platen 37 opposed to a recording head and supporting the recording paper sheet S, and a discharging portion 35 for discharging the recording paper sheet S after an image is recorded to the recording paper sheet S.

In the platen 37 of this embodiment, plural ribs 37*a* are arranged at an interval of 30 mm (15, 45, 75, 105, 135, 165, 195 mm from a left-hand end) from a position separated by 15 mm from a left-hand end of the recording paper sheet S of an A4 size in the irregularity forming discharging portion of the platen 37. The recording paper sheet S is supported on an upper face of each of these ribs 37*a*. A height of each rib 37*a* is set such that the gap between the recording head and the recording paper sheet S supported on the upper face of the rib 37*a* is minimized. A portion of the rib 37*a* opposed to the recording head is arranged in parallel with an ink discharging portion of the recording head. A portion of the rib 37*a* on an upstream side in the conveying direction of the recording paper sheet in the vicinity of the conveying roller 33*a* is formed in a taper shape in which this portion of the rib 37*a* is gradually raised along the conveying direction of the recording paper sheet S from a position lower by about 1 mm than the upper face of the rib 37*a* to a height of this upper face. In contrast to this, a portion of the platen 37 except for the rib 37*a* is formed such that this portion is lower by about 2 mm than the upper face of the rib 37*a*.

In the conveying portion 33 of this embodiment, an axis of the driven roller 33*b* is also located in a position separated by about 2 mm on a downstream side from an axis of the conveying roller 33*a*. An end tip of the conveyed recording paper sheet S hits against the taper portion of the rib 37*a* and the recording paper sheet S is then pressed against the upper face of the rib 37*a*.

The discharging roller 35*a* is constructed such that plural rubber rollers 35*c* coming in contact with the recording paper sheet S are respectively formed to have about 4 mm in width and are attached to a metallic shaft at an equal interval. In this embodiment, each rubber roller 35*c* is arranged at an interval of 30 mm (45, 75, 105, 135, 165 mm from a left-hand end) from a position separated by 45 mm from a left-hand end of the recording paper sheet S. Each rubber roller 35*c* is arranged in conformity with the rib 37*a* of the platen 37 with respect to the conveying direction of the recording paper sheet S.

The recording paper sheet S is conveyed by the above construction while the recording paper sheet S is pressed against the upper face of the rib 37*a*. At this time, when ink is discharged from the recording head to the recording paper sheet S, the recording paper sheet S is expanded by water of the ink and an expanded portion enters a low portion between ribs 37*a*. As a result, a portion of the recording paper sheet S supported by the upper face of the rib 37*a* becomes "convex" and a portion of the recording paper sheet S between the ribs 37*a* adjacent to each other becomes "concave". Namely, irregularities of a corrugated plate shape in a main scanning direction (a reciprocating direction of the recording head) are formed in the recording paper sheet S having the discharged ink. At this time, the gap between the recording paper sheet S and the recording head is minimized in a portion (convex portion) supported on the upper face of the rib 37*a*. Accordingly, it is possible to prevent a paper face of the recording sheet S from being rubbed by the recording head. The recording paper sheet S recorded above is then conveyed and discharged to the exterior of the recording apparatus. In the recording paper sheet S recorded by discharging the ink, no irregularities mentioned above are formed in a subscanning direction (the conveying direction of the recording paper sheet S).

Further, as mentioned above, a height of each rib 37*a* is set so as to minimize the gap between the recording head and the recording paper sheet S supported on the upper face of the rib 37*a*. Thus, dispersion in a gap difference of the irregularities of the recording paper sheet S can be set to lie within the range of an allowing gap amount at an ink discharging time of the recording head so that a preferable image can be formed.

The recording paper sheet supporting portion in the recording apparatus of this embodiment will next be explained.

The recording paper sheet supporting portion in the recording apparatus of this embodiment has two supporting members 38 arranged near both end portions of the discharging roller 35*a* of the discharging portion 35.

The supporting members 38 support the rear face of a printing face of the recording paper sheet S over an entire width. Each supporting member 38 is arranged in each of positions separated by 15 mm and 195 mm from a left-hand end of the recording paper sheet S. Each supporting member 38 is located in a position conforming to each of ribs 37*a* at both ends of the platen 37 with respect to the conveying direction of the recording paper sheet S. Further, the height of a vertex portion of each supporting member 38 is set to be higher than the rubber 35*c*.

In accordance with the above construction, the recording paper sheet S discharged by the discharging portion 35 is curved in a concave shape in the width direction and is cantilevered. Thus, no end tip of the recording paper sheet S is bent downward and the recording paper sheet S can be discharged and stacked without rubbing an ink image face of the recording paper sheet S already discharged onto the discharging tray.

Further, in this embodiment, each of the two supporting members 38 is arranged in a position conforming to the discharging roller 35*a* of the discharging portion 35 with respect to a direction perpendicular to the conveying direction of the recording paper sheet S. Accordingly, when a rear end of the recording paper sheet S passes through the discharging portion 35, this recording paper sheet S is stacked to the recording paper sheet S already discharged onto the discharging tray from just above. Therefore, no ink image of the recording paper sheet S already discharged is rubbed by the subsequent recording paper sheet S so that the disturbance of an image can be prevented.

As explained above, each supporting member 38 is arranged in a position conforming to each of the ribs 37*a* at both ends of the platen 37 with respect to the conveying direction of the recording paper sheet S. Thus, the rear face of a convex portion at each of both side ends among the irregularities of a corrugated plate shape formed in the recording paper sheet S is supported by the supporting member 38. A rear face of each concave portion of the recording paper sheet S is escaped to a portion between the respective rubber rollers 35*c* of the discharging roller 35*a*. Accordingly, in this embodiment, no portion to be originally "concave" in the irregularities of the recording paper sheet S becomes "convex" by a raising operation of the supporting member 38. Therefore, it is possible to prevent an ink attaching face of the recording paper sheet S from coming in contact with the recording head.

(Fourth Embodiment)

Figure 9:
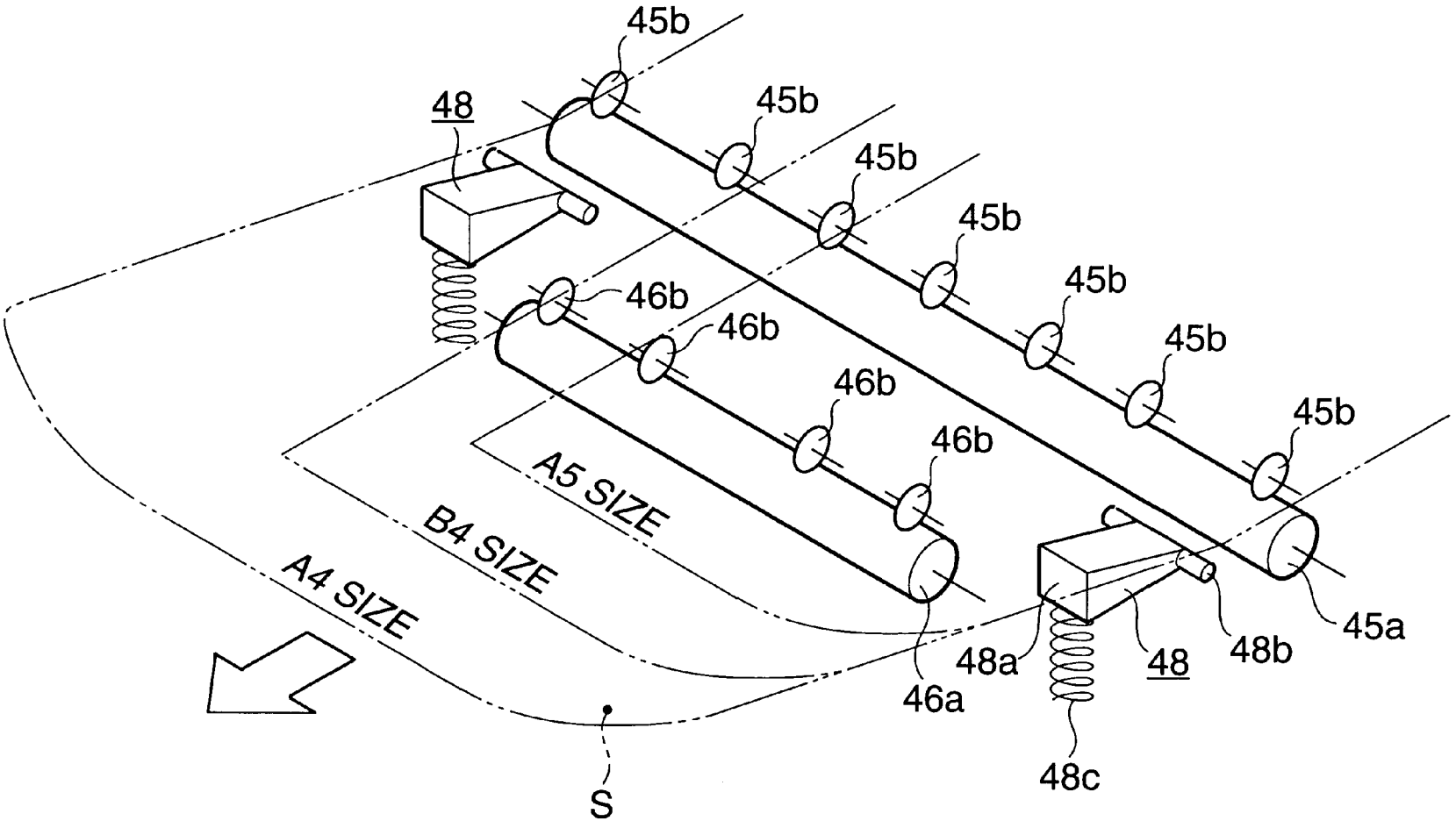
FIG. 9 is a perspective view showing an irregularity forming discharging portion, a recording paper sheet supporting portion, and conveying states of various kinds of recording paper sheets in a fourth embodiment of the recording apparatus of the present invention.
Figure 10:
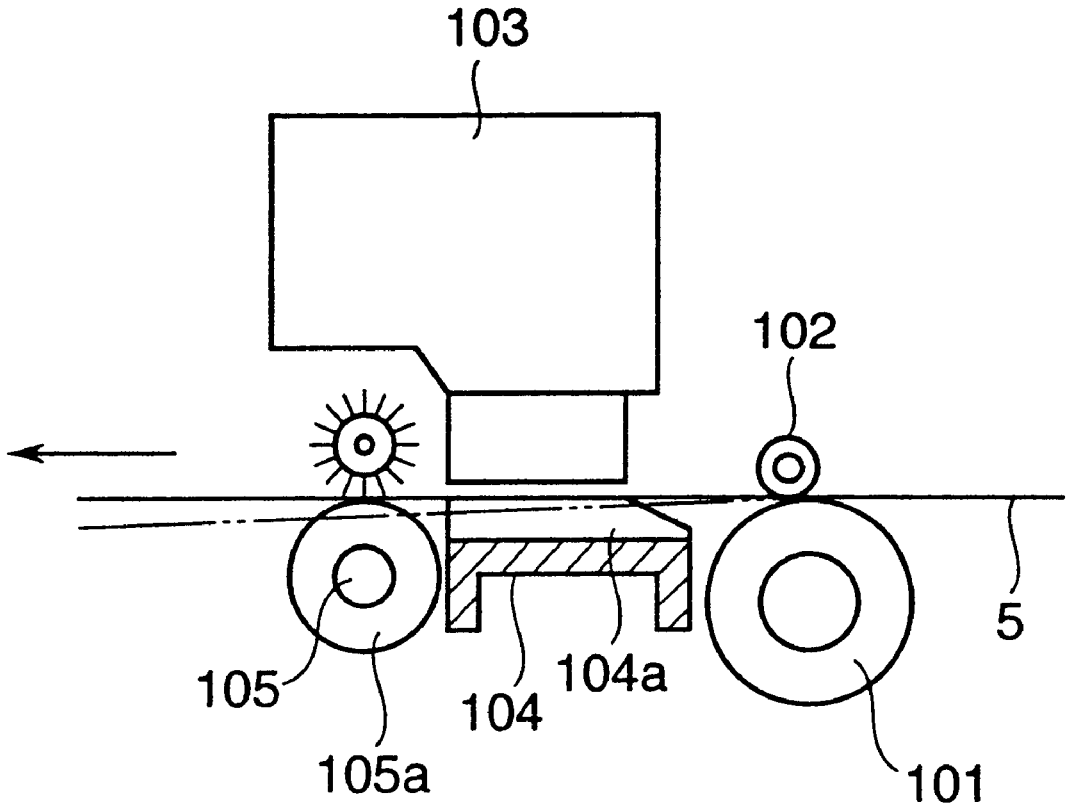
FIG.10 PRIOR ART
FIG. 10 is a cross-sectional view showing an irregularity forming discharging portion in a conventional recording apparatus.
Figure 11:
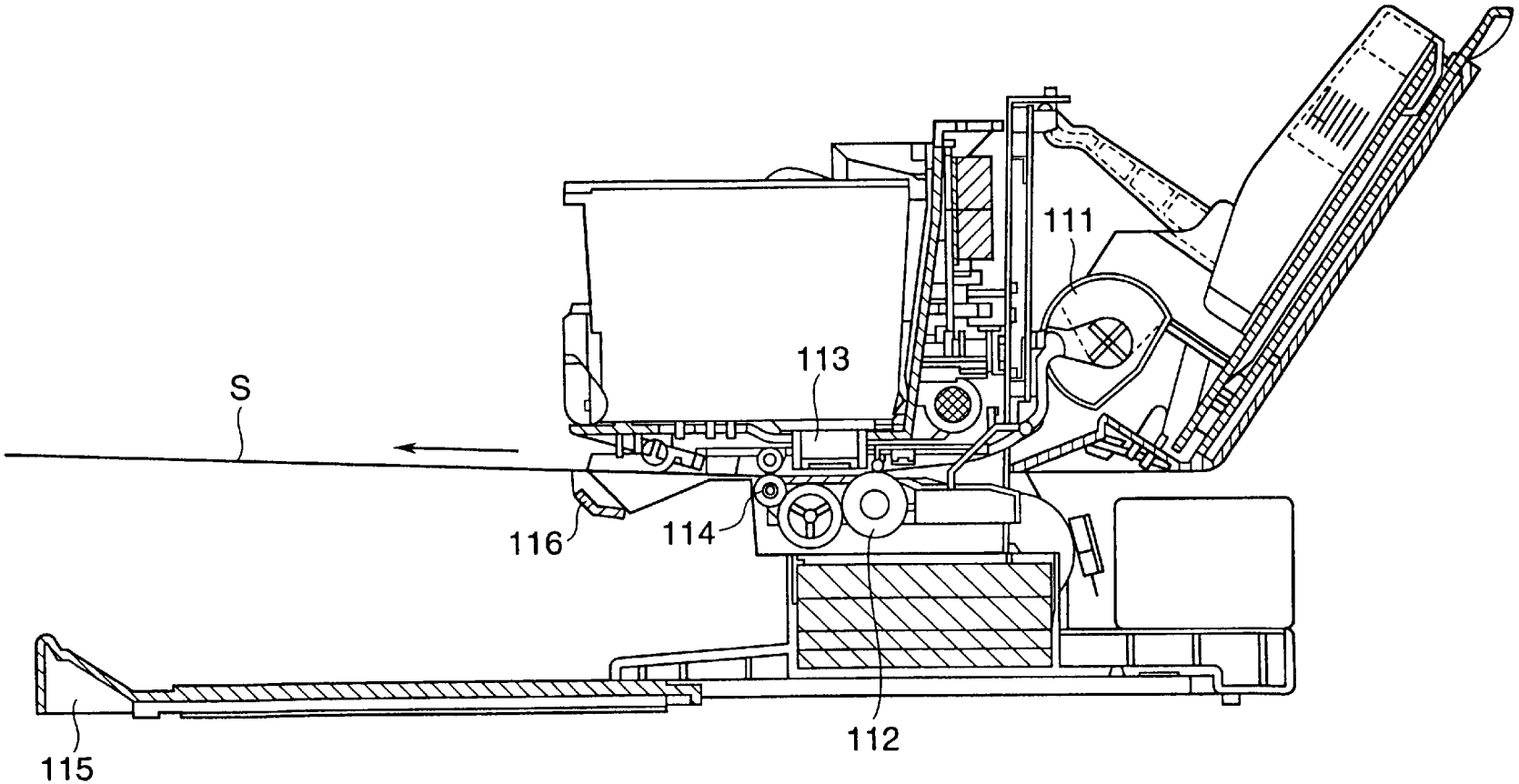
FIG.11 PRIOR ART
FIG. 11 s a cross-sectional view showing another conventional recording apparatus.
Figure 12:
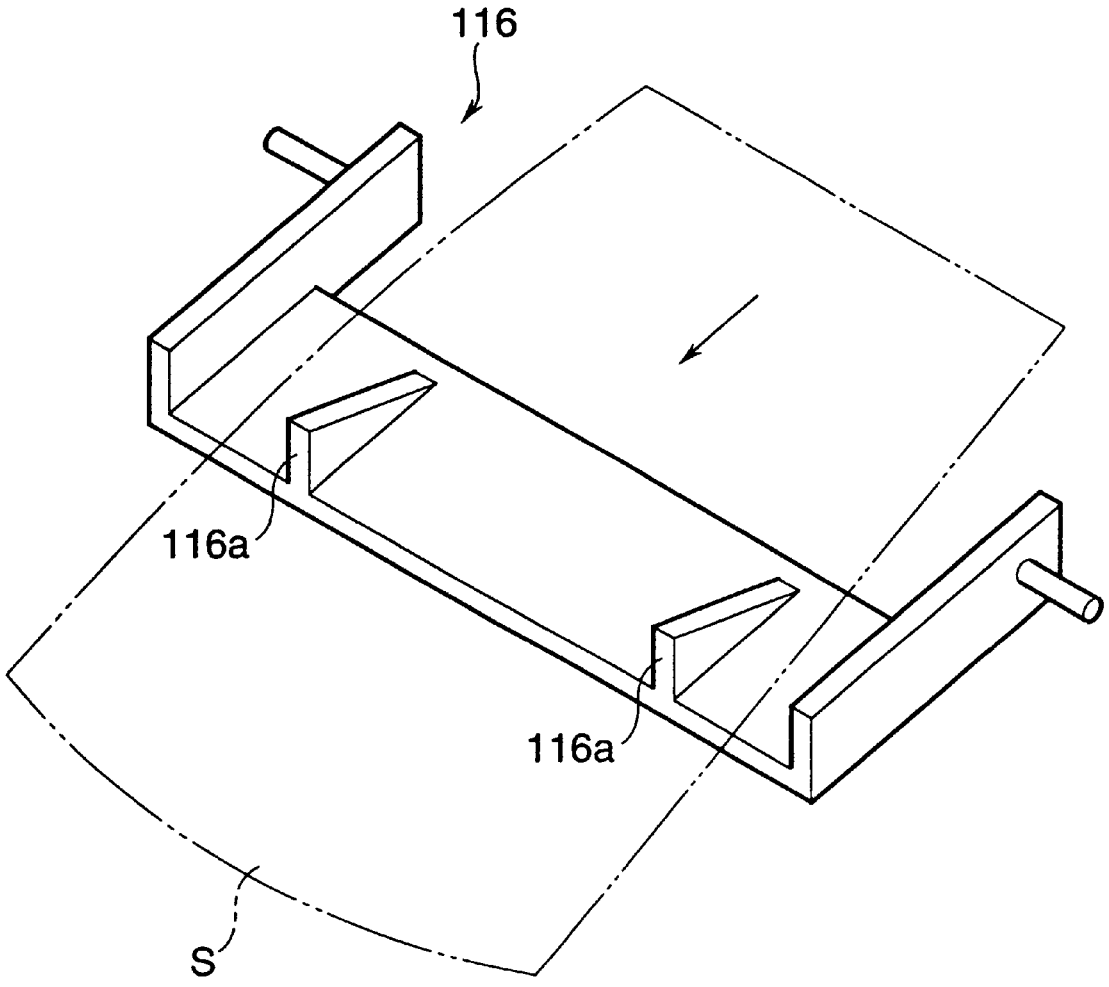
FIG. 12 PRIOR ART
FIG. 12 is a perspective view showing a supporting member in the conventional recording apparatus shown in FIG. 11.
Figure 13:
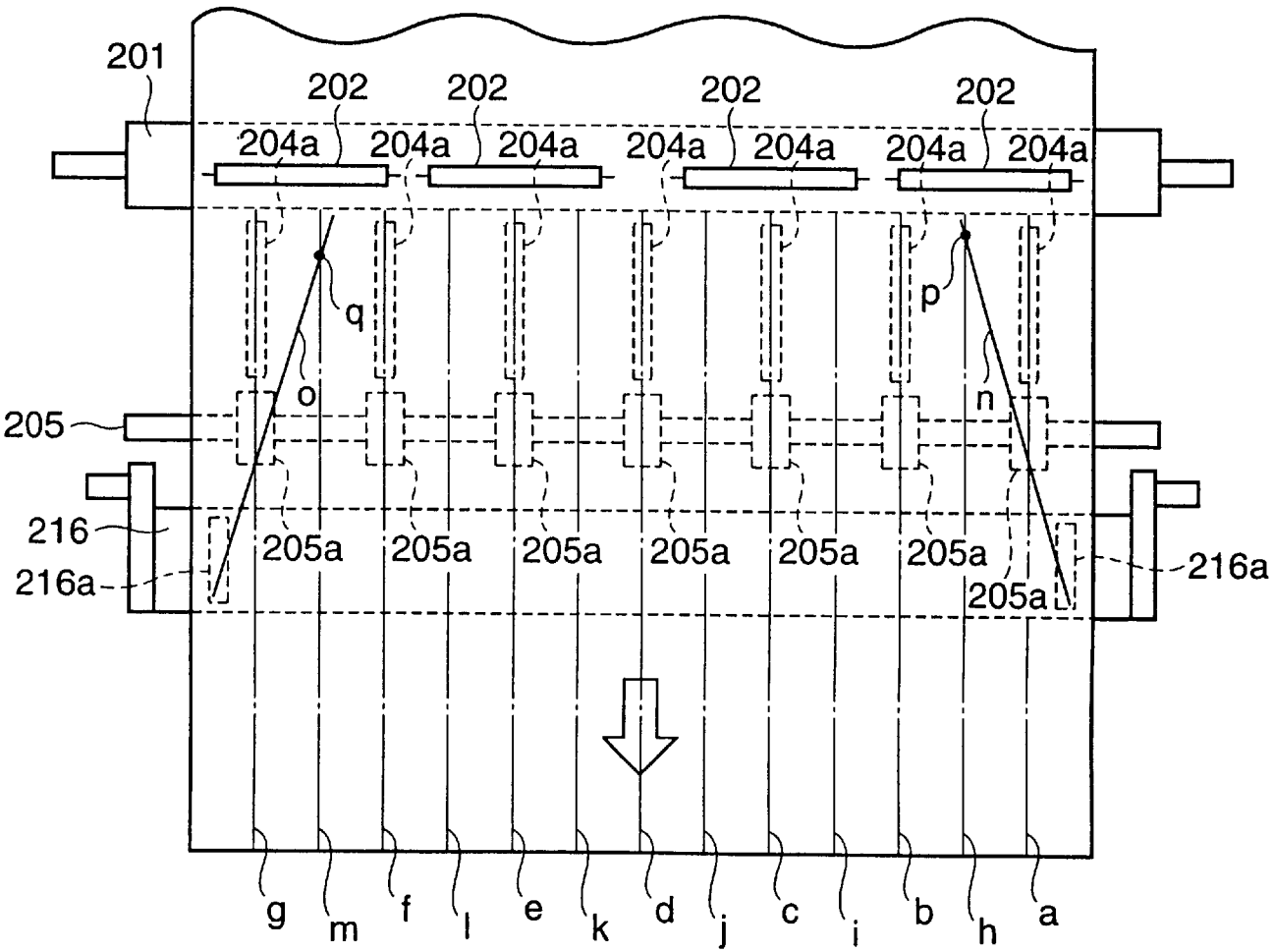
FIG.13 PRIOR ART
FIG. 13 is a plan view showing a recording paper sheet conveying portion in a recording apparatus constructed by combining respective characterizing portions of the conventional two recording apparatuss.

FIG. 9 is a typical perspective view showing a case in which the plural rubber rollers 5*c* of the first discharging roller 5*a* of the above first embodiment are replaced with a single rubber roller 45*a* and the rubber rollers 6*c* of the second discharging portion 6 are replaced with a single rubber roller 46*a*, and recording paper sheets of smaller sizes B5 and A5 are used in addition to the recording paper sheet of an A4 size mainly used.

As shown in FIG. 9, when the sheet S has a size A4, a supporting means 48 raises both ends of the sheet S on a face on a side opposed to a recorded face of this sheet S and a second discharging means 46 holds a central portion of the sheet S at the height of a sheet conveying path, and a first discharging means 45 presses an upstream side of the sheet S. Thus, the sheet S can be curved in a concave shape in a width direction and can be cantilevered. Thus; no end tip portion of the sheet S is bent downward and the sheet S can be discharged and stacked without rubbing an ink image face of the sheet S already discharged. When the sheet S has a size such as A5, B5, etc. smaller than the above size A4, the supporting means 48 near a reference side among two portions of the supporting means 48 with respect to the sheet S is set to be engaged with a lower side face of the sheet S since the sheet is conveyed by using a one-side reference as mentioned above. Accordingly, similar to a cantilever state of the sheet provided by raising both ends of the sheet as in the case of size A4, the sheet can be cantilevered by only raising one end of the sheet in the case of a small sheet. Namely, effects of the supporting means 48 can be suitably obtained irrespective of a large or small size of the sheet S.

When the sheet S of strong rigidity such as thick paper, a postcard, etc. is used and the supporting means 48 is located in a first position and the sheet S begins to be deformed in a concave shape by a set of the supporting means 48 in an end portion of the sheet and a paper discharging roller 46*a* and a spur 46*b* of the second discharging means 46 in a central portion of the sheet, the rigidity of the sheet is stronger than force of this deformation. Thus, the supporting means 48 conversely prevents conveyance of the sheet and there is a fear that problems of impossibility of the conveyance and the disturbance of a conveying accuracy are caused. Therefore, when the sheet of strong rigidity such as thick paper, etc. is used, the above problems can be avoided if the supporting means 48 is located in a second position escaped from a conveying path of the sheet. Further, the rigidity of the sheet itself is high in the case of the sheet of strong rigidity such as thick paper, etc. Therefore, the sheet S can be cantilevered without bending an end tip of the sheet downward only by supporting the sheet by a roller set in two columns of the first discharging means 45 and the second discharging means 46 even when no supporting means 48 is arranged. Thus, it is possible to obtain effects similar to those in a case in which the above sheet is curved and supported in a concave shape.

The first and second positions of such supporting means 48 are switched by operating the above spring 48*c*. The operation of this spring 48*c* will next be explained.

Figure 3:
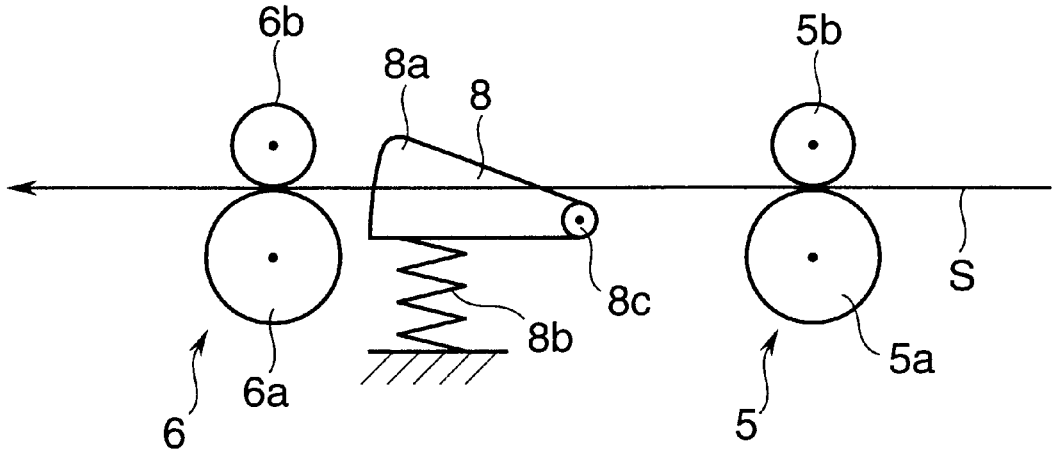
FIG. 3 is a cross-sectional view showing a supporting member and both discharging portions shown in FIG. 1, etc. in a state in which a vertex of the supporting member is located in a first position projecting to a position higher than a recording paper sheet S.

When the sheet is weak in firmness as in plain paper, etc. and is light in weight, a load for pressing the supporting means 48 by the sheet S is small. Therefore, as shown in FIGS. 3 and 5 mentioned above, the supporting means 48 is held in the first position and the sheet is curved and supported in a concave shape in the width direction as mentioned above.

Figure 4:
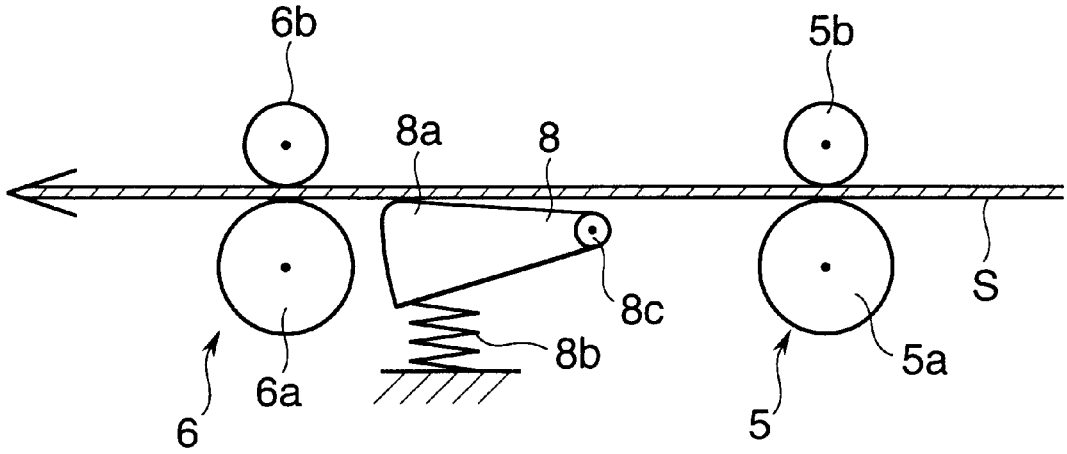
FIG. 4 is a cross-sectional view showing the supporting member and both the discharging portions shown in FIG. 1, etc. in a state in which the vertex of the supporting member is located in a second position as a position lower than the recording paper sheet S.

In contrast to this, when the sheet is strong in firmness and is heavy in weight as in thick paper, etc., the supporting means 48 is pressed by the weight and rigidity of the sheet. Therefore, as shown in FIGS. 4 and 6 mentioned above, the supporting means 48 is escaped until the second position. Thus, the position of the supporting means 48 can be automatically switched in accordance with a paper quality of the sheet S.

As shown in the above construction, the second discharging means 46 reliably discharges a rear end of the sheet S by arranging the second discharging means 46 on the downstream side of a vertex 48*a* of the supporting means 48 in its conveying direction. No rear end of the sheet is left in the supporting means 48.

Thus, in this embodiment, the sheet can be conveyed and discharged irrespective of the size of the sheet S and the paper quality while the sheet is cantilevered. Accordingly, rubbing of discharged sheets is prevented and the disturbance of an ink image in the ink jet recording system can be suitably prevented.

(Others)

Required effects can be obtained not only in the case of the fourth embodiment, but can be also similarly obtained in the above first to third embodiments when recording paper sheets of sizes B5 and A5 are used as well as the recording paper sheet of size A4.

Further, in the above first to fourth embodiments, the conveying direction of the recording paper sheet is set to be perpendicular to a moving direction of the reciprocated carriage mounting the recording head thereto. However, the conveying direction of the recording paper sheet and the moving direction of the carriage (recording head) may be set to be different from each other along a recording face (ink attaching face) of the recording paper sheet.

Further, in the above first to fourth embodiments, an image is recorded to the recording paper sheet by mounting the recording head and reciprocating the carriage. However, the recording head of a so-called full line type may be used. In this recording head, many ink discharging ports are arranged along a width direction of the recording paper sheet (a direction perpendicular to the conveying direction of the recording paper sheet), and the image can be recorded over an entire width of the recording paper sheet without moving at least the recording head in the width direction of the recording paper sheet. In this case, a recording speed is improved in comparison with the case of a so-called serial type in which the recording head is mounted to the above carriage. Accordingly, a time required to fix an ink droplet attached to the recording paper sheet is shortened so that effects of the invention of this application can be further preferably obtained.

As explained above, in the recording apparatus of each of the embodiments of the present invention, the supporting means for supporting a recording medium so as to curve this recording medium in a concave shape is arranged in a position conforming to a convex portion of the recording medium formed in a shape having corrugated irregularities by the irregularity forming discharging means with respect to a conveying direction of the recording medium. Accordingly, no portion to be originally "concave" in irregularities formed in the recording medium by the irregularity forming discharging means becomes "convex" by a raising operation of the supporting means. Therefore, it is possible to prevent a recording face (ink attaching face) of the recording paper sheet from coming in contact with the recording head even when the recording medium is supported so as to curve this recording medium in a concave shape.

What is claimed is:

1. A recording apparatus for performing a recording operation on a recording medium as the recoding medium is conveyed in a conveying direction, said apparatus comprising:

a recording unit;

irregularity forming discharging means for forming said recording medium into a corrugated shape, wherein convex portions and concave portions of the corrugated shape are adjacent and in a direction crossing the conveying direction of the recording medium, said irregularity forming discharging means located at a position opposed to said recording unit, and for discharging said recording medium from said recording apparatus; and at least two supports downstream of said irregularity forming discharging means for supporting the recording medium so as to curve the recording medium in a concave shape with respect to a direction perpendicular to said conveying direction, wherein each of the two supports is located at a position immediately below a convex portion of the recording medium adjacent a side edge of the recording medium.

2. The recording apparatus according to claim 1, wherein said irregularity forming discharging means has a platen in which plural ribs coming in contact with said recording medium are approximately arranged at an equal interval in the direction perpendicular to said conveying direction, and the platen is arranged in a position opposed to said recording unit through said recording medium, and each of said supports is arranged in a position aligned with a position of one of said ribs with respect to said conveying direction.

3. The recording apparatus according to claim 2, wherein said irregularity forming discharging means has a discharging roller in which plural roller portions coming in contact with said recording medium are approximately arranged at an equal interval in the direction crossing said conveying direction, and each of said supports is arranged in a position corresponding to a position of said discharging roller with respect to the direction crossing said conveying direction.

4. The recording apparatus according to claim 1, wherein each of said supports is constructed such that the support releases to a position below the irregularity forming discharging means when a rear end portion of said recording medium passes through said irregularity forming discharging means.

5. The recording apparatus according to any one of claims 1 to 3, wherein said recording unit is an ink jet recoding head for performing the recording operation of said recording medium by discharging ink from a nozzle.

6. A recording apparatus for performing a recording operation on a recording medium as the recording medium is conveyed in a conveying direction, said apparatus comprising:

a recording unit;

irregularity forming discharging means for forming said recording medium into a corrugated shape, wherein convex portions and concave portions of the corrugated shape are adjacent and in a direction crossing the conveying direction of the recording medium, said irregularity forming discharging means located at a position opposed to said recording unit, and for discharging said recording medium from said recording apparatus; and a support member provided at a position downstream of said irregularity forming discharging means for supporting the recording medium so as to curve the recording medium in a concave shape with respect to a direction perpendicular to said conveying direction, wherein the support member is located at a position immediately below a convex portion of the recording medium adjacent a side edge of the recording medium.

7. The recording apparatus according to claim 6, wherein said irregularity forming discharging means has a platen in which plural ribs coming in contact with said recording medium are approximately arranged at an equal interval in the direction perpendicular to said conveying direction, and the platen is arranged in a position opposed to said recording unit through said recording medium, wherein there are at least two support members, one at each side edge of the recording medium, and each of said support members is arranged in a position aligned with a position of one of said ribs with respect to said conveying direction.

8. The recording apparatus according to claim 7, wherein each of said support members is constructed such that the support releases to a position below the irregularity forming discharging means when a rear end portion of said recording medium passes through said irregularity forming discharging means.

9. The recording apparatus according to claim 6, wherein said irregularity forming discharging means has a discharging roller in which plural roller portions coming in contact with said recording medium are approximately arranged at an equal interval in the direction crossing said conveying direction, and each of said supports is arranged in a position corresponding to a position of said discharging roller with respect to the direction crossing said conveying direction.

10. The recording apparatus according to any one of claims 6 to 9, wherein said recording unit is an ink jet recoding head for performing the recording operation of said recording medium by discharging ink from a nozzle.

11. A recording apparatus for recording by using a recording head on a recording medium conveyed at a position opposed to said recording head, said apparatus comprising:

a platen for supporting a reverse side of the recording medium at a position opposable to said recording head, said platen having a plurality of projections extending toward a conveying direction of the recording medium with a predetermined interval in a direction across the conveying direction; and a support member provided along a line extending downstream of the conveying direction of said projections corresponding to a position at an end portion of the recording medium in a widthwise direction, said support member biasing the reverse side of the recording medium expelled from the recording head opposable position to a front side of the recording medium.

12. The recording apparatus according to claim 11, further comprising a plurality of recording medium pinching portions having rotary members opposed to each other in a direction across the conveying direction along the conveying direction from a position opposable to said recording head to downstream of the conveying direction, and wherein one of said projections, one of said pinching portions and said support member are arranged in this order in a line extending in the conveying direction.

13. The recording apparatus according to claim 12, further comprising a plurality of second recording medium pinching portions downstream of said plurality of recording medium pinching portions and in a direction across the conveying direction along the conveying direction from a position opposable to said recording head to downstream of the conveying direction, and wherein said support member is provided at the same position as or upstream of said second recording medium pinching portions with respect to the conveying direction.

14. The recording apparatus according to claim 11, wherein said support member biases the reverse side of the recording medium to the front side by an elastic member.

15. The recording apparatus according to any one of claims 11–14, wherein said recording head is an ink jet recording head for recording by discharging ink from a discharge port.

* * * * *

UNITED STATES PATENT AND TRADEMARK OFFICE

CERTIFICATE OF CORRECTION

PATENT NO. : 6,503,011 B2
DATED : January 7, 2003
INVENTOR(S) : Takeshi Kono

It is certified that error appears in the above-identified patent and that said Letters Patent is hereby corrected as shown below:

Title page,
Item [57], ABSTRACT,
Line 4, "direction" should read -- medium in a shape having corrugated irregularities in a direction --.

Column 4,
Line 1, "apparatuss" should read -- apparatus --.
Line 16, "apparatuss." should read -- apparatus. --.

Column 6,
Line 15, "s" should read -- is --.
Line 24, "apparatuss." should read -- apparatus. --.

Column 7,
Line 40, "flow" should read -- flows --.
Line 44, "an" should read -- a --.

Signed and Sealed this

Twenty-third Day of September, 2003

JAMES E. ROGAN
*Director of the United States Patent and Trademark Office*